US008556777B2

(12) United States Patent
Fields, I

(10) Patent No.: US 8,556,777 B2
(45) Date of Patent: Oct. 15, 2013

(54) INDIVIDUAL WORKOUT SYSTEM

(75) Inventor: Freeman D. Fields, I, Chicago, IL (US)

(73) Assignee: Freeman D. Fields, I, Atlanta, GA (US)

( * ) Notice: Subject to any disclaimer, the term of this patent is extended or adjusted under 35 U.S.C. 154(b) by 0 days.

(21) Appl. No.: 12/283,480

(22) Filed: Sep. 12, 2008

(65) Prior Publication Data

US 2009/0111668 A1 Apr. 30, 2009

Related U.S. Application Data

(60) Provisional application No. 60/993,401, filed on Sep. 13, 2007.

(51) Int. Cl.
*A63B 21/005* (2006.01)
*A63B 21/02* (2006.01)
*A63B 21/045* (2006.01)

(52) U.S. Cl.
USPC ..... 482/5; 482/4; 482/124; 482/127

(58) Field of Classification Search
USPC ..... 482/121, 124, 127, 49, 50, 44, 46, 122, 482/92, 80, 77, 91, 126, 139; 602/16, 5, 21, 602/23, 26, 27; 601/5, 23, 27, 33, 34
See application file for complete search history.

(56) References Cited

U.S. PATENT DOCUMENTS 2,542,316 A * 2/1951 Farrar, Jr. ..... 623/61
2,959,168 A * 11/1960 Shook ..... 602/26
4,115,902 A * 9/1978 Taylor ..... 16/221
4,130,115 A * 12/1978 Taylor ..... 602/16
4,370,977 A * 2/1983 Mauldin et al. ..... 602/16
4,606,542 A * 8/1986 Segal ..... 482/124
5,052,379 A * 10/1991 Airy et al. ..... 602/16
5,261,871 A * 11/1993 Greenfield ..... 602/26
5,316,546 A * 5/1994 Lindh et al. ..... 602/16
5,395,304 A * 3/1995 Tarr et al. ..... 602/26
5,399,138 A * 3/1995 Jones ..... 482/127
5,472,412 A * 12/1995 Knoth ..... 602/26
5,575,764 A * 11/1996 Van Dyne ..... 602/26
5,626,545 A * 5/1997 Newman et al. ..... 482/127
5,683,353 A * 11/1997 Hamersly ..... 602/16
5,891,061 A * 4/1999 Kaiser ..... 601/33
6,045,491 A * 4/2000 McNergney et al. ..... 482/121
RE37,297 E * 7/2001 Smith, III ..... 602/26
7,393,335 B2 * 7/2008 Carvey et al. ..... 602/26
2004/0153015 A1 * 8/2004 Seligman et al. ..... 602/16

* cited by examiner

*Primary Examiner* — Oren Ginsberg
*Assistant Examiner* — Shila Jalalzadeh Abyane

(57) ABSTRACT

The Individual Workout System allows an user to perform a complete workout regiment to build muscles without the use of weights, while achieving a cardiovascular workout at the same time. The system could be worn by an individual during aerobics, walking, jogging or doing menial tasks. The Individual Workout System is uniquely design to use resistance to build muscle without restricting an individual to weights or equipment. By placing a thin devise used to create resistance in the place of the bodies joints and flex points, such as the shoulders, elbows, knees and waist, causes resistance for the muscles in that region of the body.

5 Claims, 8 Drawing Sheets

INDIVIDUAL WORKOUT SYSTEM

RELATED APPLICATIONS

This application is related to the provisional application Ser. No. 60/993,401 filed Sep. 13, 2007 entitled "Body Armor-Workout System"

TECHNICAL FIELD

This invention relates to the body mechanics in performing athletic activities, such as aerobics, weightlifting, walking, running, riding and fitness training. More specifically it relates to gaining a complete fitness workout without the use of weights or equipment. This mobility would also allow the user to build and tone muscles while performing a cardiovascular workout. This could be achieved by attaching a strengthening apparatus to the body at the joints, to create muscle resistance. This resistance would cause the muscles to strain, therefore, assisting in the process of building muscle mass.

BACKGROUND ART

It has been known for years that resistance training builds muscles. Placing a reasonable amount of resistance on the muscle for a short period of time causes the muscles to work harder. It is the force needed to combat the resistance that causes the muscle to over work. Each muscle is made up of hundreds of muscle fibers enclosed in a sheath of connective tissue. When an individual trains with weights and other forms of resistance training, the extra resistance causes minute tears in these fibers. During the muscle resting period, the muscular fibers begin to repair themselves. In doing so, the muscle fibers become larger and stronger.

By stressing a muscle's anaerobic energy system in this way for several months will produce changes in the muscles that are completely different from those produced by aerobic exercise. With repeated resistance training, over time the protein filaments inside each muscle fiber grows thicker and more numerous, increasing the diameter of exercised muscles.

As an individual becomes older, resistance training is able to prevent many illnesses associated with aging. From the age of 30, the body begins to lose bone mass, making the bones increasingly susceptible to fractures and other problems. Studies have shown that weight-bearing exercises can help increase bone mineral density, preventing brittle bones and degenerative conditions such as osteoporosis. By improving the efficiency with which your body uses sugar, resistance training decreases your chance of developing diabetes and reduces the likelihood of heart problems. It helps lower blood pressure and regulates cholesterol levels. In addition, stronger muscles mean less demand on the heart during the day.

Another benefit of resistance training is that it works in several ways to help increase flexibility. By increasing muscle strength, it assists in preventing tendon injuries. This increase in strength gives the muscles and tendons a greater range of motion without suffering damage. Resistance training also keeps tendons pliable over time so they return to their resting length after being stretched. Another way it helps is by giving an individual the ability to control the area of the body being stretched, as well as maintain that position. This prevents tears and over rotation, or dislocation of a joint.

There are many different types of resistance training. The most common form of resistance training is weightlifting and weight-bearing training. Weightlifting involves the use of weights and other heavy objects to create the resistance needed to build muscles. This popular form of exercise is used by the young and old alike. Ranging from a mild workout to national heavy-lifting competition, it has become one of the world's most recognizable sports and pass-time. By lifting weights, an individual could use it as a means to staying fit or sculpturing their body.

Although there are many advantages to lifting weights, there are also some set backs. One of the biggest problem with weightlifting is injury. Each year thousands of people suffer injuries from weightlifting. There are a number of reasons in which weight-bearing training could cause injuries. The most common cause for weightlifting injuries is improper use. Before commencing a weight-bearing workout, one should know the proper technique to avoid injuries. By placing to much or misplacing weight on the body will induce inadequate force to the muscles and bones. This force could cause substantial pain, discomfort, strains, ruptures or even dislocations.

Some of the other explanations for injuries with weightlifting are over working the muscles, aggravating pre-existing injuries, accidental slippage and equipment malfunction. It doesn't take much weight to cause a serious, sometime permanent injury. Five pounds on an awkwardly placed wrist could easily strain or tear ligaments in the Brachioradialis (forearm). The three most common places that injuries occur in the body are Latissimus Dorsi (back), Biceps Brachii (biceps) and the Deltoid (shoulder). When using weights, proper precaution must be taken by novices and experts before beginning an exercise sessions.

Weight-bearing exercise dates back hundreds of years and is still one of the most popular forms of strength training today. However, there are several other forms of exercises that do not use weights for building and shaping muscles. A quickly growing trend for muscle building and toning incorporates resistance, as oppose to weights, to reach the desired result. This form of workout uses the constant resistance of stretched bands, cords or Rods to implement muscle strain.

With this form of training an individual would position himself so he could stretch one or several bands, cords or rods. As he stretches them, they resist and try to return to their original position. It is this resistance that causes the muscles to overwork. The further the individual stretches them, the greater the resistance. This could be done by simply fixing a band or cord to a stationary object, or by using equipment with the same principles.

There are some advantages to using resistance bands and cords. A huge advantage of using resistance bands and cords is that they are able to provide the same amount of resistance as weights without having to bear a heavy load. With resistance bands and cords, the only time force is needed is during the actual stretching process. Therefore, the impact and excessive stress placed on the body with traditional weights is absent. The reduction in load bearing stress on the body and the increase in mobility by the use of flexible bands or cords gives an individual a greater range of motion, therefore, greatly reducing the chance for injuries.

Other benefits of using resistance bands or cords are that they could be used in small isolated areas, as oppose to weights which acquire ample space to operate. By strategically placing the bands in the appropriate place, an individual could perform an attire upper and lower body workout while sitting in a chair or standing. They require very limited space for storage, set-up and use. The Individual Workout System uses the same principles of these resistance apparatus. It creates resistance for building muscles by the use of tension from Tension Cords. However, unlike many traditional resistance bands, cords and rods, an individual could attach the Individual Workout System to their body to achieve maximum results and greater mobility during a workout session (Drawing FIG. 6).

This increase in mobility gives the user the ability to perform cardiovascular exercises, such as aerobics and jogging, while obtaining the same benefits of weight-bearing and resistance training Drawing FIG. 6). Aerobics and other cardiovascular exercises help burn calories and lose weight. None the less, it is muscle tissues underneath the fat that define the body's shape. Weight training works these muscles and unlike cardiovascular exercise, allows an individual to target specific areas of the body. With the Individual Workout System, both of these goals are achieved.

Because the Individual Workout System does not use any weights or heavy equipment, it could be worn by elders, children and rehabilitation patients. It could be incorporated into an individual's daily routine or during rigorous workouts. And the simple construction of the system means it would be cost effective. The Attachment Apparatus of the Individual Workout System could be worn independently on different areas of the body to target specific muscle groups, or as a whole for a complete body workout.

Another unique feature of the Individual Workout System is that the system's Attachment Apparatus could be sown into sporting apparel, creating a total body workout suit (Drawing FIG. 5). Once the Strengthening Apparatus are removed from the Pockets of the Attachment Apparatus, the apparel could be worn as normal clothing. The Individual Workout System is a perfect opportunity for an individual to obtain a workout that burns fat, increases the cardio and builds muscles.

BRIEF DESCRIPTION OF SEVERAL VIEW OF DRAWING

A fuller understanding of the nature and objects of the present invention will become apparent upon consideration of the following detailed description taken in connection with the accompanying drawings, wherein.

DETAILED DESCRIPTION OF THE INVENTION

Figure 3:
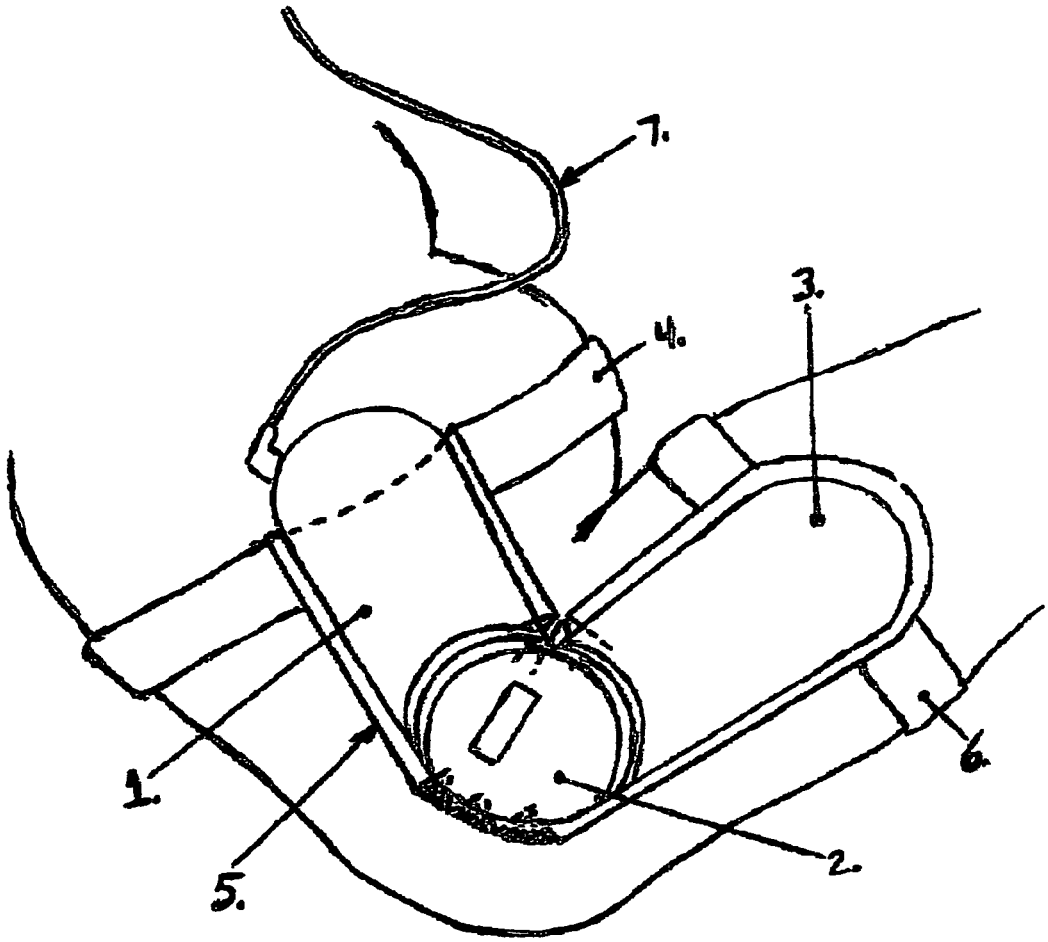
FIG. 3 is a frontal view of the Strengthening Apparatus partially bent and a prospective interior view of the Attachment Apparatus partially bent strapped to the arm of the wearer.

The Purpose of the Attachment Apparatus (2A) is to provide means for attaching the Strengthening Apparatus (1A) to the arms, legs, waist and ankles of an individual (FIG. 3). Each Attachment Apparatus (2A) is comprised of three parts. The three parts of an Attachment Apparatus are a Pocket (5), an Upper Elastic Strap (4) and a Lower Elastic Strap (6).

Figure 1:
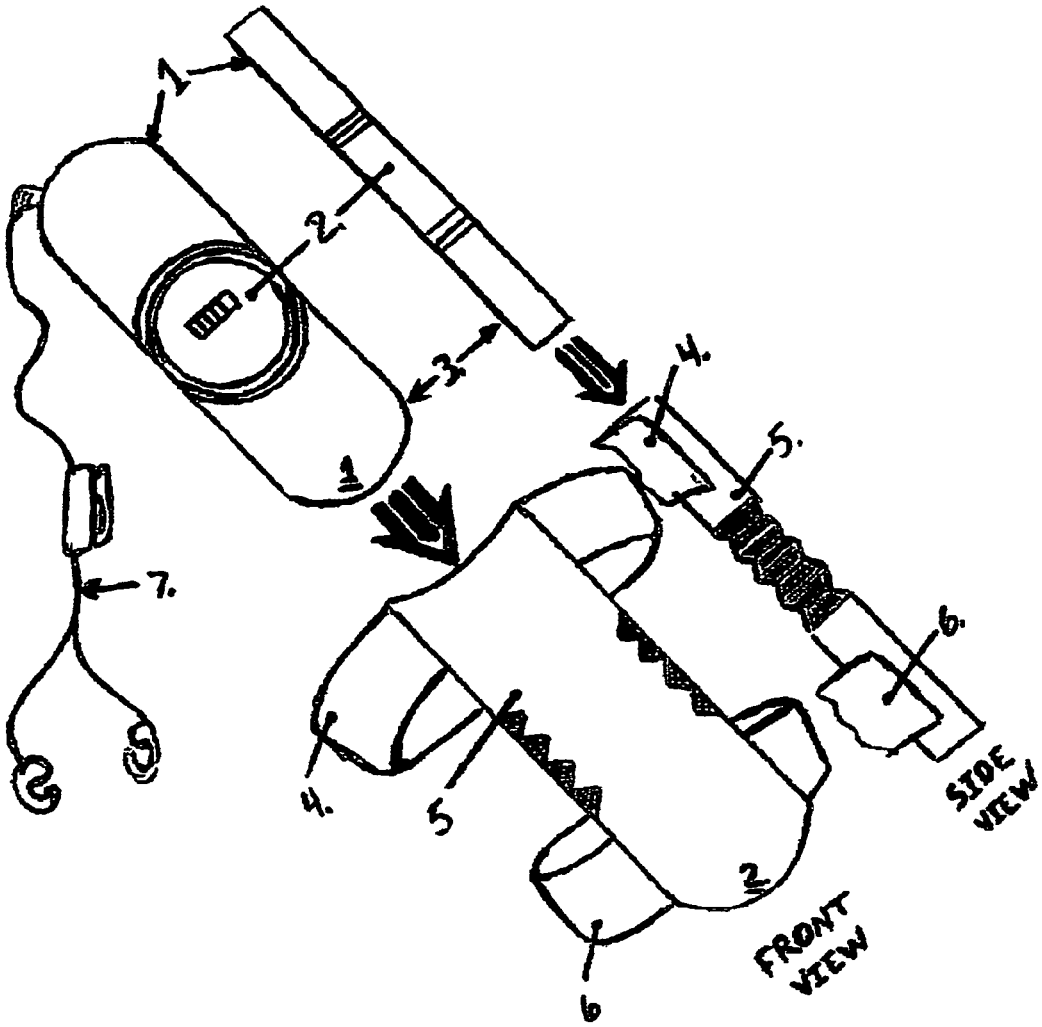
FIG. 1 is a perspective front and side view of the Strengthening Apparatus fully extended above the Attachment Apparatus.

The Pocket (5) is a thin holster, with flexible ribs on both sides. It has an opening at the top and is closed at the bottom (FIG. 1). Made out of durable nylon like material, it has limited elasticity. The Pocket (5) is designed to holster the Strengthening Apparatus (1) and attaches to the body in the areas of the joints and body flex points (FIG. 3), such as the elbows, knees, waist, ankles and shoulders. With The Pocket (5) opening positioned upward, it runs horizontal to the appendix or the member of the body in which it is attached (FIG. 3). If the Attachment Apparatus (2A) is placed on the arm (FIG. 3), The Pocket would run laterally along the outer side of the arm, straddling it from the proximately of the Biceps to the Brachioradialis (forearm) (FIG. 3). As the arm flexes and extends, the Pocket bends freely in correspondence to the arm (FIG. 3).

The Upper Elastic Strap (4) is a strip of elastic attached to the top of the Pocket (5) near the opening (FIG. 1). The Upper Elastic Strap (4) is part of the Attachment Apparatus (5) that attaches the top portion of the unit to a specific member of the body and holds it in place (FIG. 3). The Upper Elastic Strap (4) is made up of rubber like material that is designed with a large range of elasticity. When securing the Attachment Apparatus (5) to the body, the Upper Elastic Strap (4) is placed above the joint or a body's flex point (FIG. 3). The Upper Elastic Strap (4) keeps the top portion of the Pocket (5) in place and prevents it from moving (FIG. 3). If the Attachment Apparatus (2A) is placed on the arm (FIG. 3), the Upper Elastic Strap (4) is positioned above the elbow, in the proximately of the Biceps (FIG. 3).

The Lower Elastic Strap (6) is a strip of elastic attached to the Pocket (4) at the bottom (FIG. 1). The Lower Elastic Strap (6) is the part of the Attachment Apparatus (2A) that attaches the lower portion of the unit to a specific member of the body and holds it in place (FIG. 3). Also made of rubber like material, it is designed with a large range of elasticity. When securing the Attachment Apparatus (2A) to the body, the Lower Elastic Strap (6) is placed below the joint or the body flex point (FIG. 3). The Lower Elastic Strap (6) keeps the bottom portion of the Pocket (4) in place and prevents it from moving (FIG. 3). If the Attachment Apparatus (2A) is placed on the arm (FIG. 3), the Lower Elastic Strap (6) is positioned below the elbow, in the proximately of the Brachioradialis (forearm) (FIG. 3).

Figure 4:
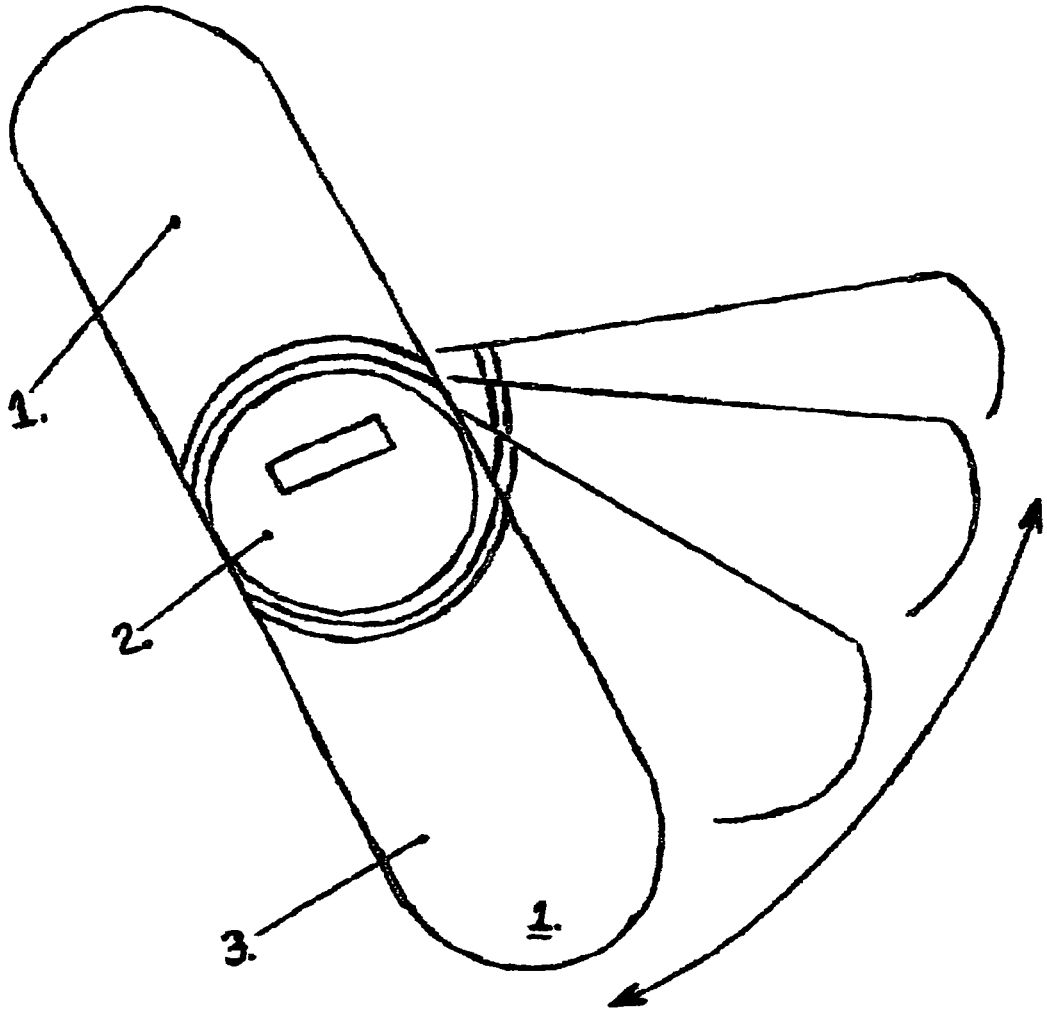
FIG. 4 is frontal exterior view of the Strengthening Apparatus with arrows and prospective views to show the Strengthening Apparatus range of motion.
Figure 8:
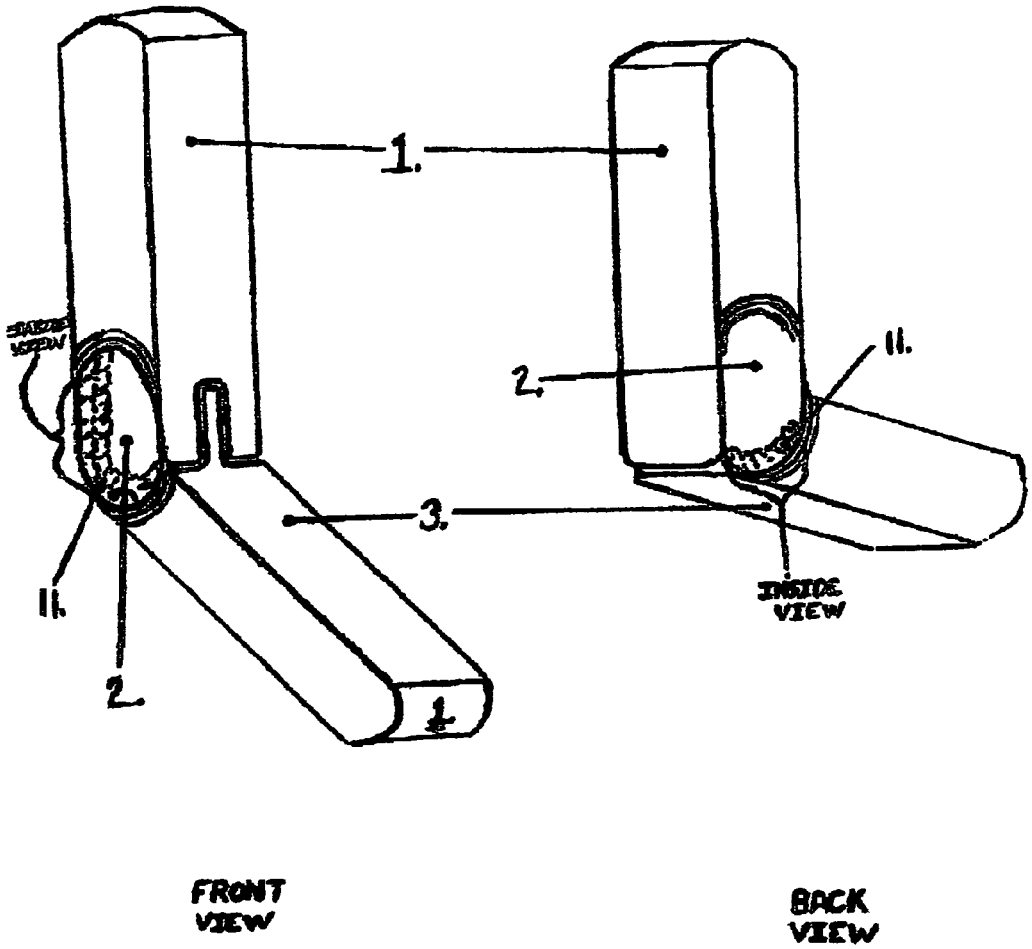
FIG. 8 is a front and back view of the Strengthening Apparatus with a cut away view of the Center Piece to show the relationship of the Tension Cables.

The purpose of the Strengthening Apparatus (1A) is to provide resistance to build and tone muscle mass while performing aerobics, running, bike riding, performing cardiovascular exercises, etc. . . . The Strengthening Apparatus (1A) is an elongated devise that bends once an ample amount of force is applied (FIG. 4). The Strengthening Apparatus (1A) is to be inserted into the Pocket (4) of the Attachment Apparatus (2A) (FIG. 1). Once the Strengthening Apparatus (1A) is securely fixed inside the Pocket (4) of the Attachment Apparatus (2A), the wearer flexes or extends that member of the body and the Strengthening Apparatus (1A) bends in correspondence to the body's movement (FIG. 3). The Strengthening Apparatus (1A) is made up of three major parts, an Upper Arm (1), a Center Piece (2), a Lower Arm (3) (FIG. 8).

The Upper Arm (1) is the top portion of the Strengthening Apparatus (1A). Made of hard plastic, the Upper Arm (1) is fixed to the Center Piece (2) in such a way that allows it to swivel around the top half of the Center Piece (2) (FIG. 4).

Figure 2:
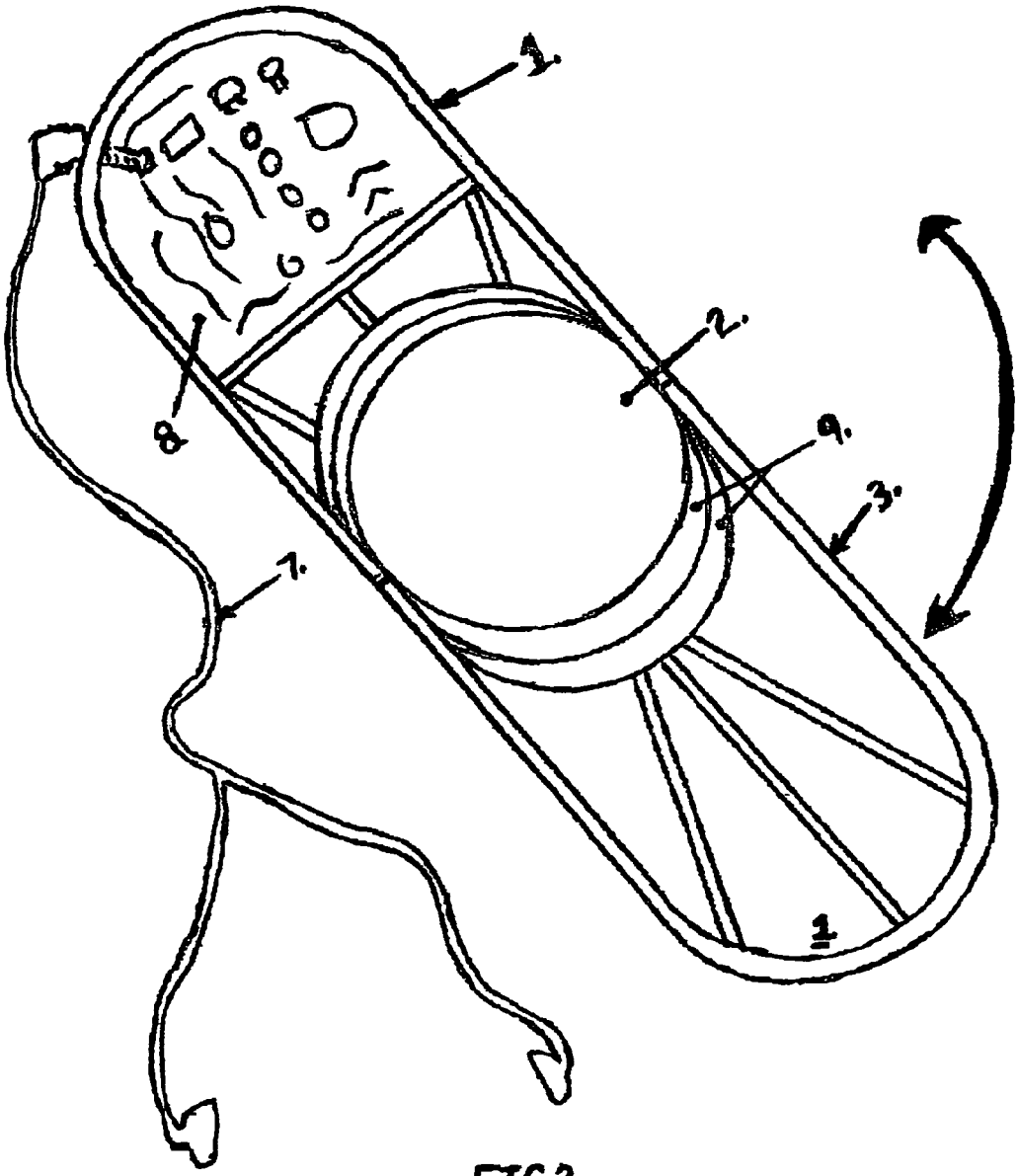
FIG. 2 is a frontal interior view of the Strengthening Apparatus fully extended.

The Upper Arm (1) is hollow and houses an MP3 Player (8) of the Strengthening Apparatus (1A) (FIG. 2).

Figure 5:
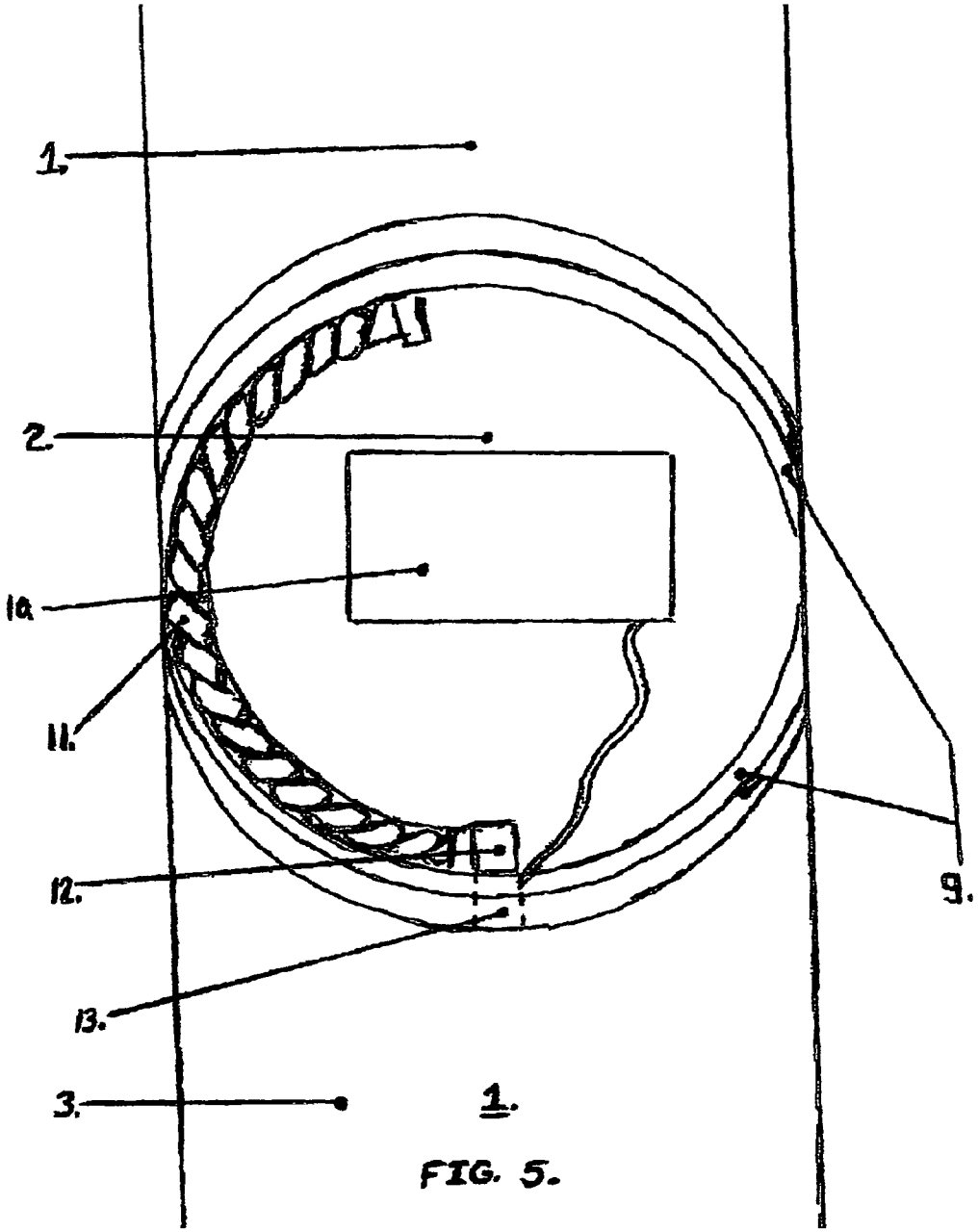
FIG. 5 is a prospective interior view of the Strengthening Apparatus fully extended to show relationship of the Tension Cables, Electronic Device, Junction Box and the Tension Cable Junction Box.

The Center Piece (2) is the heart of the Strengthening Apparatus (1A). The basic function of the Center Piece (2) is to provide, regulate and monitor the proper amount of lbs. of force needed to move the Lower Arm (3). This is accomplished by attaching the Lower Arm (3) to Tension Cables (11) at a Tension Cable Junction Box at the bottom of the Center Piece (2). The Tension Cables (11) run along one side of the inner wall, from the top of the Center Piece (2), down to the Tension Cable Junction Box (12) at the bottom of the Center Piece (2) (FIG. 5). At the end of each Tension Cable (11), inside the Tension Cable Junction Box (12), is a small noose. With the Flex Pod (1) in the straight position, the Lower Arm Connecting Rod (13) interlocks with the Tension Cable Junction Box (12), positioning the Lower Arm Connecting Rod (13) directly under the Tension Cable Junction Box (12) (FIG. 5).

Figure 6:
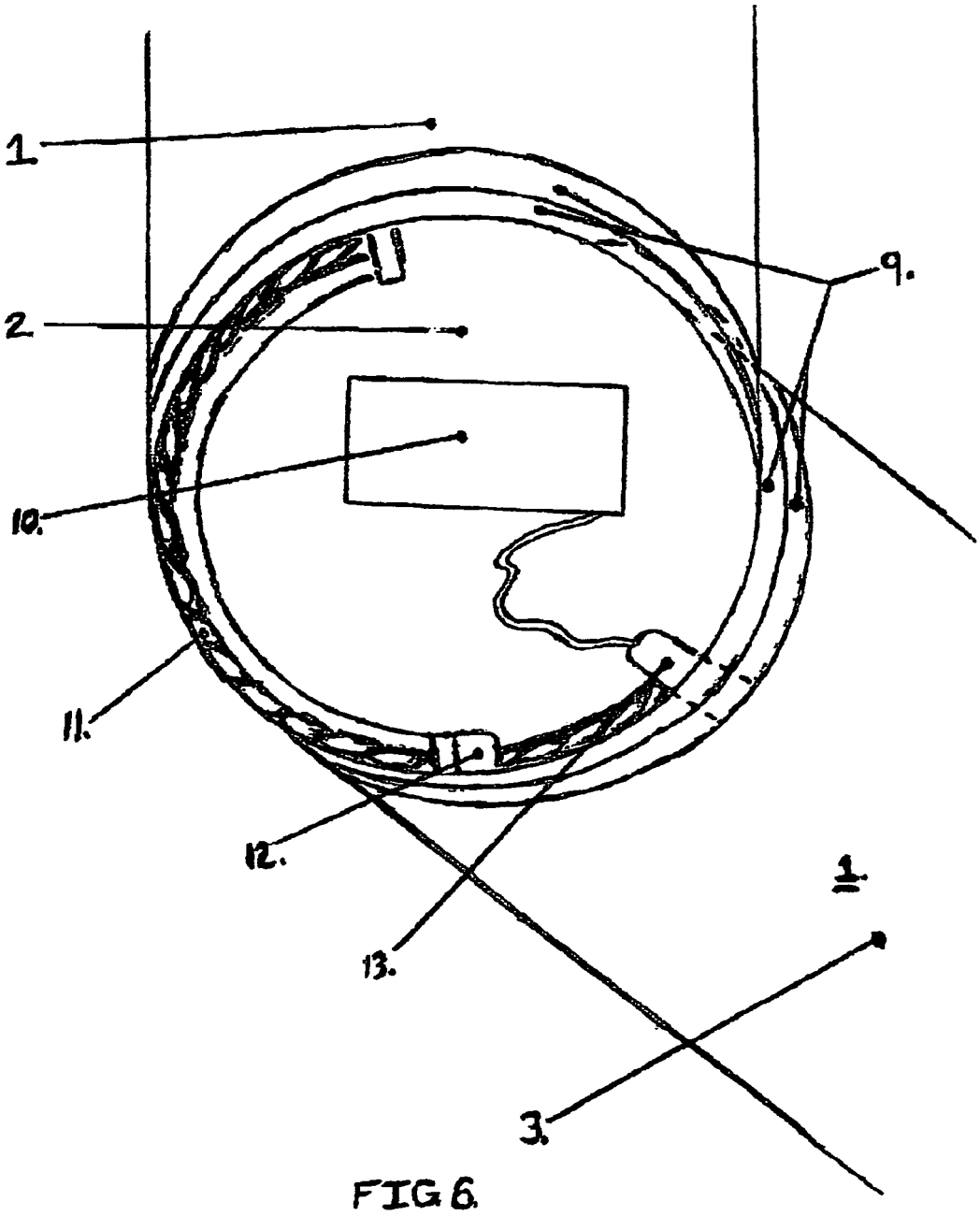
FIG. 6 is a prospective interior view of the Strengthening Apparatus partially bent to show relationship of the Tension Cables, Electronic Device, Junction Box and the Tension Cable Junction Box.
Figure 7:
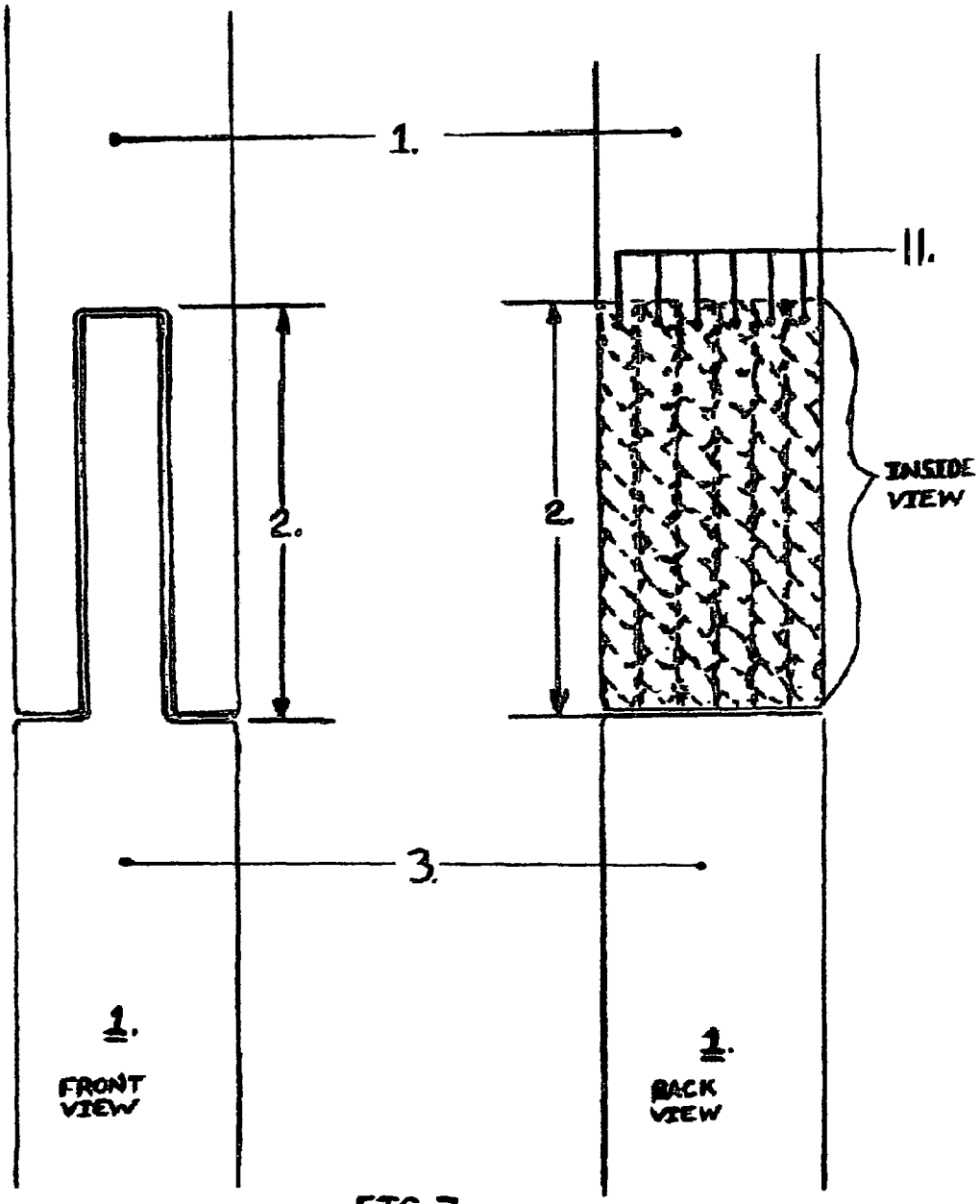
FIG. 7 is a side by side exterior and interior view of the Strengthening Apparatus and the relationship of the Tension Cables.

An Electronic Device (10) sends a signal to the Lower Arm Connecting Rod (13) to latch on to a certain number of the Tension Cables (11). Once the Lower Arm Connecting Rod (13) receives the signal, it locks on to the proper number of Tension Cables (11) by inserting a small metal pin through the noose of the Tension Cables (11), inside the Tension Cable Junction Box (12) (FIG. 5) As the Lower Arm (3) swings, taking the Lower Arm Connecting Rod (13) with it, the Tension Cables (11) are pulled as well (FIG. 6). Each cable would require a certain amount of force to pull as the Lower Arm (3) swings (FIG. 6, 7, 8). The more Tension Cables (11) the Lower Arm Connecting Rod (13) latches on to, the greater the lbs of force needed to swing the Lower Arm (3) (FIG. 6, 7, 8).

The Lower Arm (3) is the bottom portion of the Strengthening Apparatus (1A). The purpose of the Lower Arm (3) is to provide leverage to the user when using the Strengthening Apparatus (1A). The Lower Arm (3) is affixed to the Center Piece (2) in such a way that it swivels around the bottom half of the Center Piece (2) (FIG. 4). The Lower Arm (3) has a Lower Arm Connecting Rod (13) that protrudes into the bottom section of the Center Piece (2) and interlocks into the Tension Cable Junction Box (12). After the Lower Arm Connecting Rod (13) attaches to a certain number of Tension Cables (11) inside the Tension Cable Junction Box (12), as the Lower Arm (3) swings forward, the Tension Cables (11) are pulled with it.

What is claim is:

1. A muscle strengthening device, the device comprising:

a hollow upper arm providing a housing;

a center piece, the center piece being connected to the hollow upper arm, a tension cable junction box, the tension cable junction box housing a plurality of tension cables and is located within the center piece, a lower arm, the lower arm being connected to the tension cable junction box at a bottom of the center piece, a lower arm connecting rod, and an electronic device, the electronic device being coupled to the center piece, and configured to control the movement of the lower arm, wherein the hollow upper arm is connected to the center piece and enables unidirectional rotational swiveling of the hollow upper arm around a top half of the center piece, wherein the electronic device sends a signal to the lower arm connecting rod to latch onto a certain number of the tension cables, and wherein once the lower arm connecting rod receives the signal, it locks on to the certain number of tension cables by inserting a pin through a noose of the tension cable inside the tension cable junction box.

2. The muscle strengthening device of claim 1, wherein the connecting rod protrudes into the bottom of the center piece and interlocks the lower arm into the tension cable junction box.

3. The muscle strengthening device of claim 1, wherein a music playing device is located inside the housing provided by the hollow upper arm.

4. The muscle strengthening device of claim 1, wherein the device is a user wearable device.

5. The human muscle strengthening apparatus of claim 1, wherein the center piece is configured to neighbour a human joint.

* * * * *